US006405783B1

(12) United States Patent
Smith

(10) Patent No.: US 6,405,783 B1
(45) Date of Patent: Jun. 18, 2002

(54) HORIZONTAL WINDOW BLIND APPARATUS

(75) Inventor: Brian W Smith, Evansville, WI (US)

(73) Assignee: Advanced Innovations, LLC., Reedsburg, WI (US)

( * ) Notice: Subject to any disclaimer, the term of this patent is extended or adjusted under 35 U.S.C. 154(b) by 0 days.

(21) Appl. No.: 09/746,991

(22) Filed: Dec. 23, 2000

(51) Int. Cl.[7] ..... E06B 9/30
(52) U.S. Cl. ..... 160/176.1 R; 160/178.3 R
(58) Field of Search ..... 160/168.1 R, 173 R, 160/176.1 R, 177 R, 178.3 R, 236

(56) References Cited

U.S. PATENT DOCUMENTS 1,590,886 A * 6/1926 Carella
2,280,931 A * 4/1942 Rice
2,413,464 A * 12/1946 Nihon
5,165,459 A * 11/1992 Gaber et al.
5,375,642 A * 12/1994 Gaber et al.
5,409,050 A * 4/1995 Hong

FOREIGN PATENT DOCUMENTS

DE 2628822 * 1/1975

* cited by examiner

*Primary Examiner*—Blair M. Johnson
(74) *Attorney, Agent, or Firm*—David J. Archer

(57) ABSTRACT

A horizontal window blind apparatus is disclosed for selectively controlling light transfer through a window. The apparatus includes a frame disposed within the window and a tab movably connected to and supported by the frame, the tab having a first and a second end. A slat has a front and a rear edge, the rear edge of the slat being connected to the first end of the tab such that the slat is cantilevered from the tab. A further tab is movably connected to and supported by the frame, the further tab having a first and a second extremity. Also, a further slat is disposed parallel relative to the slat, the further slat having a further front and a further rear edge. The further rear edge of the further slat is connected to the first extremity of the further tab such that the further slat is cantilevered from the further tab. The arrangement is such that in operation of the apparatus, when the tabs supported by the frame are moved, the slats cantilevered to the tabs are correspondingly moved for selectively controlling the light transfer through the window and for facilitating cleaning of the slats.

15 Claims, 7 Drawing Sheets

HORIZONTAL WINDOW BLIND APPARATUS

BACKGROUND OF THE INVENTION

1. Field of the Invention

The present invention relates to a horizontal window blind apparatus. More specifically, the present invention relates to a horizontal window blind apparatus for selectively controlling light transfer through a window.

2. Information Disclosure Statement.

Horizontal window blinds of various sizes are used for covering windows and the like so that when the horizontal window blind is closed, the blind serves as a curtain for screening the window. Typically, the prior art horizontal window blinds have included a cord ladder for supporting each slat of the horizontal window blind. The ladder is supported at the upper end thereof by a frame so that when the ladder is manipulated, the slats are tilted from an open to a closed disposition thereof.

Also, a typical horizontal window blind further includes a lifting cord which passes through an aperture in each of the slats so that when the lifting cord is pulled, each of the slats, starting with the lowermost slat, is raised until all the slats are moved parallel relative to each other in an upward direction for permitting cleaning of the glass window therebehind.

However, because of the location of the ladders and the lifting cord extending through the slats, cleaning of the slats has proved to be a tedious and time consuming chore.

The present invention overcomes the aforementioned problem associated with the prior art horizontal window blind arrangements by having the ladders and lifting cord located away from the slats so that cleaning of the slats is facilitated.

Also, because of the unique arrangement for supporting the slats according to the present invention, when the slats are closed, the slats will not overlap each other as they do in the prior art arrangements. Therefore, according to the present invention, less slats are required thereby reducing the cost of manufacture thereof.

Additionally, the present invention makes it possible for the slats to be removed for cleaning or for exchanging so that the room decor may be altered.

Therefore, it is a primary feature of the present invention to provide a horizontal window blind apparatus that overcomes the problems associated with the prior art arrangements.

Another feature of the present invention is the provision of a horizontal window blind apparatus that facilitates cleaning of the slats.

A further feature of the present invention is the provision of a horizontal window blind apparatus that reduces the cost of production of such apparatus.

Another feature of the present invention is the provision of a horizontal window blind apparatus that permits removal of individual slats for changing a room decor or for cleaning the slats.

Other features and advantages of the present invention will be readily apparent to those skilled in the art by a consideration of the detailed description of a preferred embodiment of the present invention contained herein.

SUMMARY OF THE INVENTION

The present invention relates to a horizontal window blind apparatus for selectively controlling light transfer through a window. The apparatus includes a frame disposed within the window and a tab movably connected to and supported by the frame, the tab having a first and a second end. A slat has a front and a rear edge, the rear edge of the slat being secured to the first end of the tab such that the slat is cantilevered from the tab. A further tab is movably connected to and supported by the frame, the further tab having a first and a second extremity. Also, a further slat is disposed parallel relative to the slat, the further slat having a further front and a further rear edge. The further rear edge of the further slat is secured to the first extremity of the further tab such that the further slat is cantilevered from the further tab. The arrangement is such that in operation of the apparatus, when the tabs supported by the frame are moved, the slats cantilevered to the tabs are correspondingly moved for selectively controlling the light transfer through the window and for facilitating cleaning of the slats.

In a more specific embodiment of the present invention, the frame includes a member which defines an inverted channel, the member being disposed parallel relative to the slats.

Furthermore, the frame further includes an elongate control rotatably supported by the member so that the elongate control is disposed within the inverted channel.

Also, a flexible ladder has a first and a second termination, the first termination being connected to the elongate control. A further flexible ladder has a first and a second end, the first end of the further ladder being connected to the elongate control. The arrangement is such that, in operation of the apparatus, when the elongate control is rotated, the flexible ladder moves in a first direction and the further ladder moves in a second direction, the first and second directions being opposite to each other. The second termination of the ladder is connected adjacent to the first end of the tab and the second end of the further ladder is connected adjacent to the second end of the tab so that, when the elongate control is rotated, the first and second ends of the tab move in opposite directions such that the cantilevered slat is tilted relative to the frame.

Moreover, the ladder includes a rung which is disposed adjacent to the first end of the tab so that when the ladder is moved in the first direction, the first end of the tab is lifted for opening the slat.

Also, the further ladder includes a further rung which is disposed adjacent to the second end of the tab so that when the further ladder is moved in the first direction, the second end of the tab is lifted for closing the slat.

In one embodiment of the present invention, the tab is formed integrally with the slat. More specifically, the tab and the slat are integrally molded of plastics material.

In another embodiment of the present invention, the tab and the slat are stamped from a metal sheet.

In yet another embodiment of the present invention, the tab defines a first slot which is disposed adjacent to the first end of the tab for fixedly engaging the ladder. Also, the tab further defines a second slot which is disposed adjacent to the second end of the tab for fixedly engaging the further ladder.

In another embodiment of the present invention, the tab includes a first portion having a proximal and a distal end, the proximal end being rigidly secured to the rear edge of the slat. Also, a second portion defines a recess for removably receiving therein the distal end of the first portion, the second portion being connected to and supported by the frame.

In yet another embodiment of the present invention, the second portion has a first and a second end and the apparatus further includes a cord having a first and a second termination, the second termination being secured to the first end of the second portion. A further cord has a first and a second end, the second end of the further cord being secured to the second end of the second portion. The arrangement is such that, in operation of the apparatus, when the cord is moved in a first direction, the slat is tilted in the first direction for opening the slat and when the further cord is moved in the first direction, the slat is tilted in a second direction which is opposite to the first direction for closing the slat.

Additionally, the apparatus includes a lowermost slat and a flexible lifting device which has an upper and a lower end. The lower end is rigidly secured to the lowermost slat, the lifting device being slidably threaded through a first and a second aperture defined by the further tab and the tab respectively. The arrangement is such that, in operation of the apparatus, when the lifting device is moved in a first direction, the lifting device slides through the first aperture until the further slat is moved in the first direction by the lowermost slat and the lifting device slides through the second aperture until the slat is moved in the first direction by the lowermost slat and the further slat.

More specifically, the lifting device is a lifting cord and a counterweight is incorporated into the second end of the tab for compensating for the weight of the slat. Also, a further counterweight is incorporated into the second extremity of the further tab for compensating for the weight of the further slat.

In a preferred embodiment of the present invention, when the slat and further slat are closed, the front edge of the slat is disposed closely adjacent to the further rear edge of the further slat so that overlapping of the further slat by the slat is avoided.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

Throughout the specification the term "horizontal window blind" includes a mini-blind, venetian blind or other type of blind having horizontally disposed slats. Also, included would be blinds having curved slats as described herein and flat slats. Furthermore, the slats would be fabricated from wood, aluminum, PVC or any other suitable type of window blind material.

BRIEF DESCRIPTION OF THE DRAWINGS

Similar reference characters refer to similar parts throughout the various views and embodiments of the present invention.

DETAILED DESCRIPTION OF THE DRAWINGS

Figure 1:
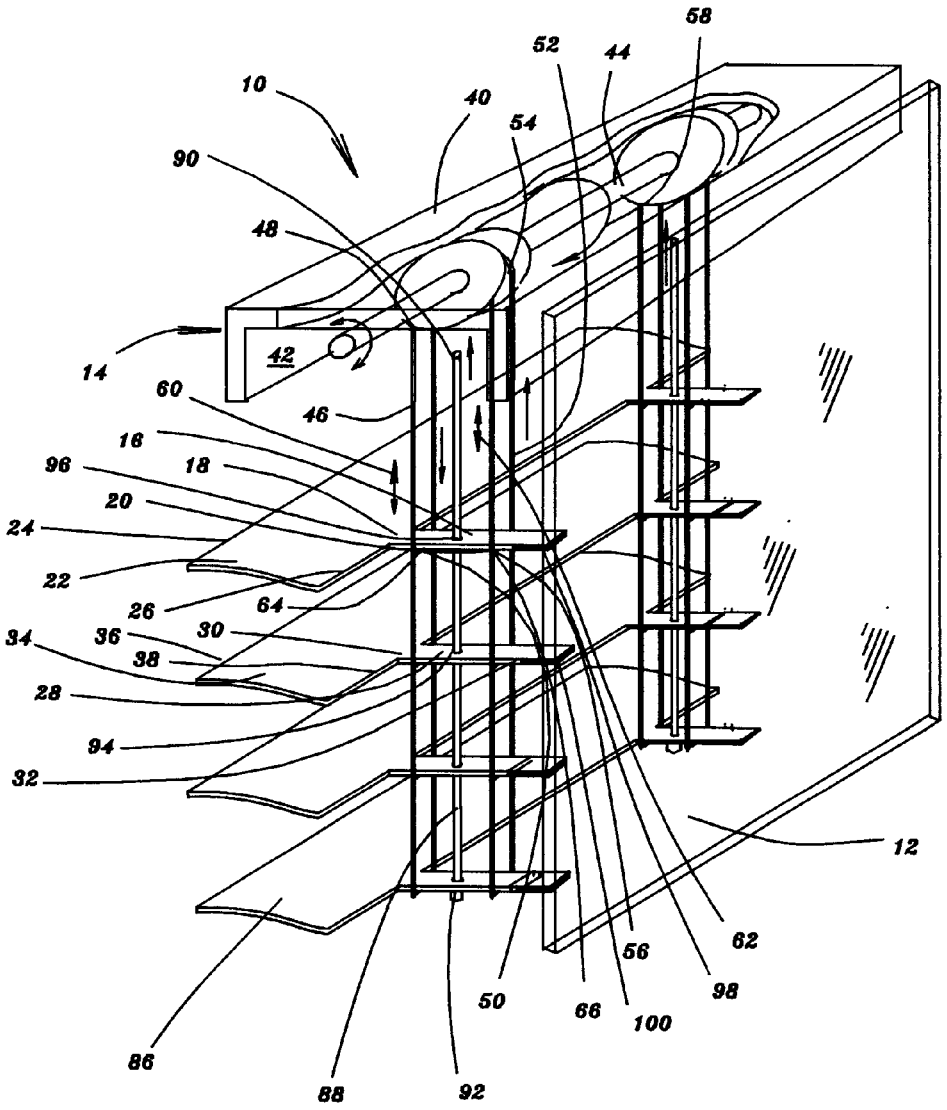
FIG. 1 is a perspective view of a horizontal window blind apparatus according to the present invention.

FIG. 1 is a perspective view of a horizontal window blind apparatus generally designated 10 according to the present invention for selectively controlling light transfer through a window 12. The apparatus 10 includes a frame generally designated 14 disposed within the window 12 and a tab 16 movably connected to and supported by the frame 14, the tab 16 having a first and a second end 18 and 20 respectively. A slat 22 has a front and a rear edge 24 and 26 respectively, the rear edge 26 of the slat 22 being secured to the first end 18 of the tab 16 such that the slat 22 is cantilevered from the tab 16. A further tab 28 is movably connected to and supported by the frame 14, the further tab 28 having a first and a second extremity 30 and 32 respectively. Also, a further slat 34 is disposed parallel relative to the slat 22, the further slat 34 having a further front and a further rear edge 36 and 38 respectively. The further rear edge 38 of the further slat 34 is secured to the first extremity 30 of the further tab 28 such that the further slat 34 is cantilevered from the further tab 28. The arrangement is such that in operation of the apparatus 10, when the tabs 16 and 28 supported by the frame 14 are moved, the slats 22 and 34 cantilevered to the tabs 16 and 28 respectively are correspondingly moved for selectively controlling the light transfer through the window 12 and for facilitating cleaning of the slats 22 and 34.

In a more specific embodiment of the present invention, the frame 14 includes a member 40 which defines an inverted channel 42, the member 40 being disposed parallel relative to the slats 22 and 34.

Furthermore, the frame 14 further includes an elongate control 44 rotatably supported by the member 40 so that the elongate control 44 is disposed within the inverted channel 42.

Also, a flexible ladder 46 has a first and a second termination 48 and 50 respectively, the first termination 48 being connected to the elongate control 44. A further flexible ladder 52 has a first and a second end 54 and 56 respectively, the first end 54 of the further ladder 52 being connected to the elongate control 44. The arrangement is such that, in operation of the apparatus 10, when the elongate control 44 is rotated as indicated by the arrow 58, the flexible ladder 46 moves in a first direction as indicated by the arrow 60 and the further ladder 52 moves in a second direction as indicated by the arrow 62, the first and second directions 60 and 62 respectively being opposite to each other. The second termination 50 of the ladder 46 is connected adjacent to the first end 18 of the tab 16 and the second end 56 of the further ladder 52 is connected adjacent to the second end 20 of the tab 16 so that, when the elongate control 44 is rotated as shown by arrow 58, the first and second ends 18 and 20 respectively of the tab 16 move in the opposite directions 60 and 62 respectively such that the cantilevered slat 22 is tilted relative to the frame 14.

Moreover, the ladder 46 includes a rung 64 which is disposed adjacent to the first end 18 of the tab 16 so that when the ladder 46 is moved in the first direction 60, the first end 18 of the tab 16 is lifted for opening the slat 22.

Also, the further ladder 52 includes a further rung 66 which is disposed adjacent to the second end 20 of the tab 16 so that when the further ladder 52 is moved in the first direction 60, the second end 20 of the tab 16 is lifted for closing the slat 22.

In one embodiment of the present invention as shown in FIG. 1, the tab 16 is formed integrally with the slat 22. More specifically, the tab 16 and the slat 22 are integrally molded of plastics material.

In another embodiment of the present invention, the tab 16 and the slat 22 are stamped from a metal sheet (not shown).

Figure 2:
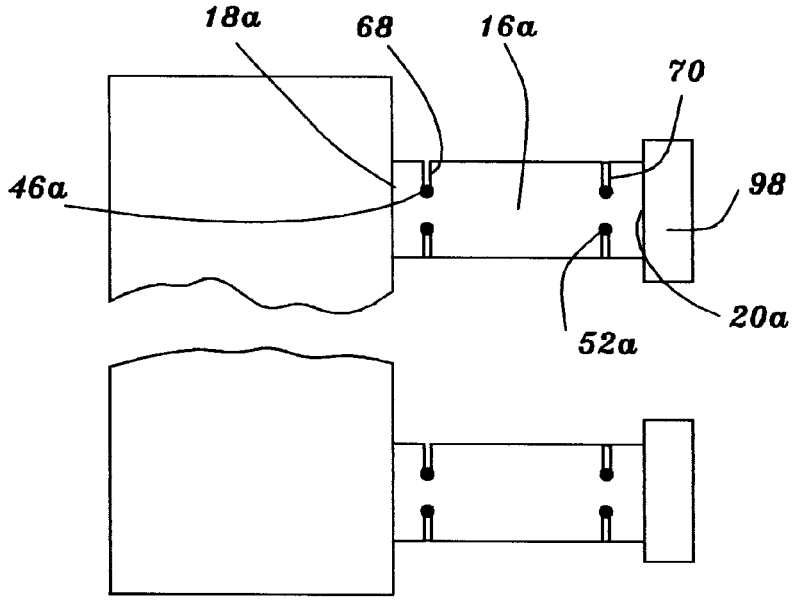
FIG. 2 is a top plan view of a horizontal window blind apparatus according to another embodiment of the present inventions

FIG. 2 is a top plan view of another embodiment of the present invention. As shown in FIG. 2, the tab 16*a* defines a first slot 68 which is disposed adjacent to the first end 18*a* of the tab 16*a* for fixedly engaging the ladder 46*a*. Also, the tab 1 6a further defines a second slot 70 which is disposed adjacent to the second end 20*a* of the tab 16*a* for fixedly engaging the further ladder 52*a*.

Figure 3:
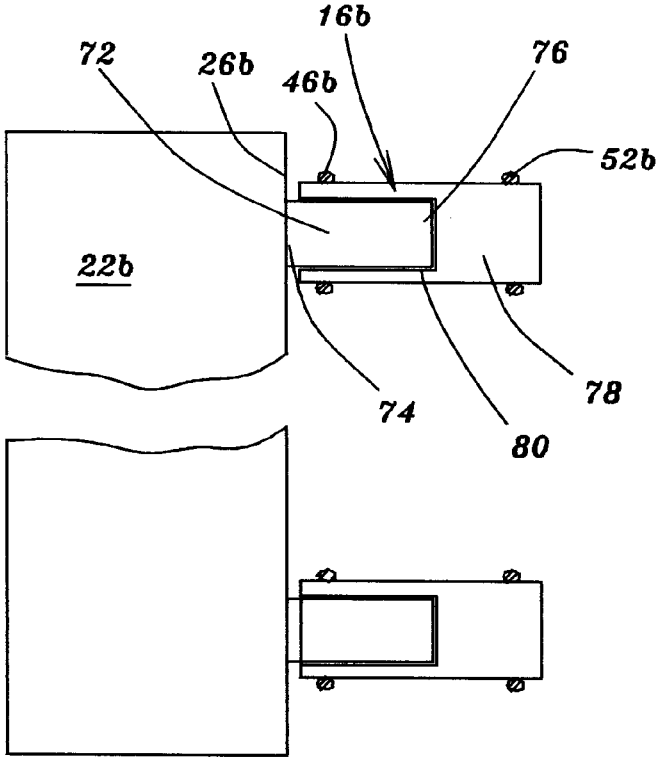
FIG. 3 is a top plan view of a horizontal window blind apparatus according to yet another embodiment of the present invention.

FIG. 3 is a top plan view of yet another embodiment of the present invention. As shown in FIG. 3, the tab generally designated 16*b* includes a first portion 72 having a proximal and a distal end 74 and 76 respectively, the proximal end 74 being rigidly secured to the rear edge 26*b* of the slat 22*b*. Also, a second portion 78 defines a recess 80 for removably receiving therein the distal end 76 of the first portion 72, the second portion 78 being connected to and supported by the frame 14*b*.

Figure 4:
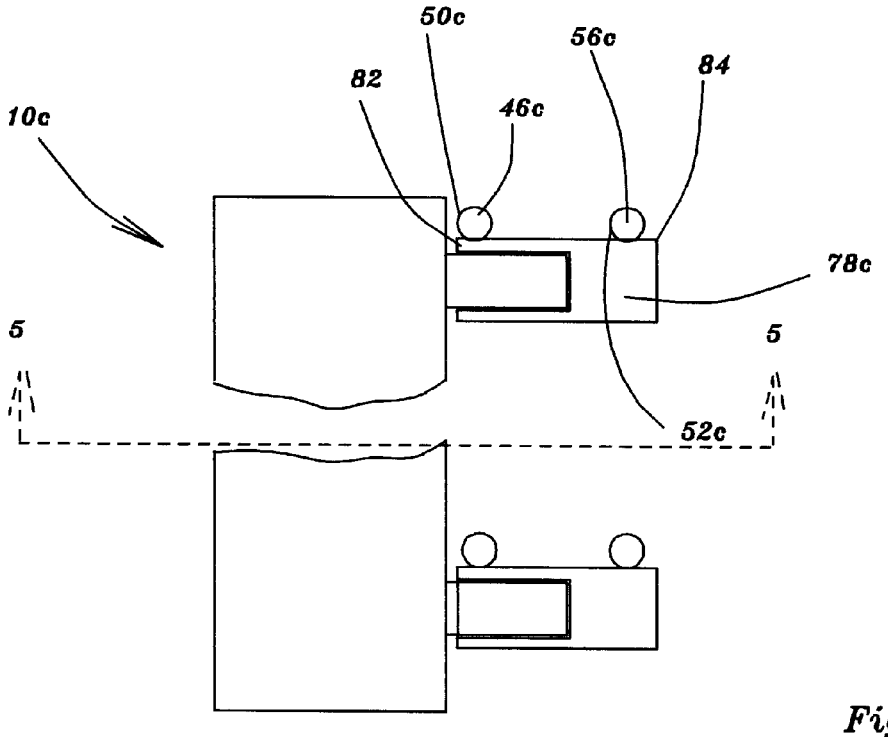
FIG. 4 is a top plan view of a horizontal window blind apparatus according to another embodiment of the present invention.

FIG. 4 is a top plan view of another embodiment of the present invention. As shown in FIG. 4, the second portion 78*c* has a first and a second end 82 and 84 respectively and the apparatus 10*c* further includes a cord 46*c* having a first and a second termination 48*c* and 50*c* respectively, to be described later herein, the second termination 50*c* being secured to the first end 82 of the second portion 78*c*. A further cord 52*c* has a first and a second end 54*c* and 56*c* respectively, to be described later herein, the second end 56*c* of the further cord 52*c* being secured to the second end 84 of the second portion 78*c*.

Figure 5:
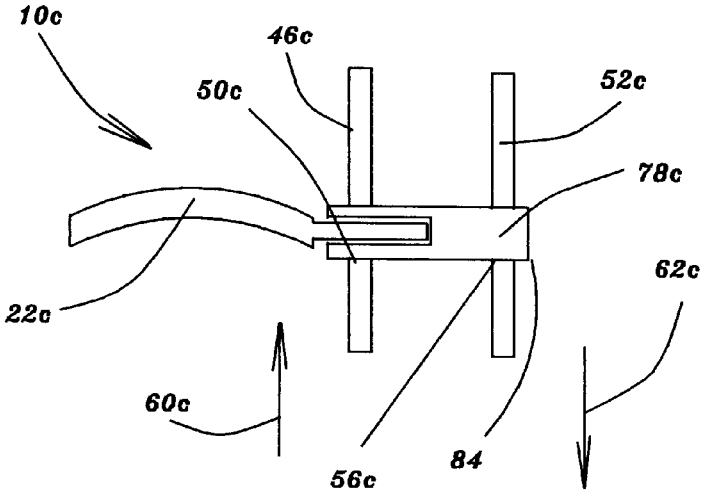
FIG. 5 is a view taken on the line 5—5 of FIG. 4.

FIG. 5 a view taken on the line 5—5 of FIG. 4. As shown in FIG. 5, the arrangement is such that, in operation of the apparatus 10*c*, when the cord 46*c* is moved in a first direction 60*c*, the slat 22*c* is tilted in the first direction 60*c* for opening the slat 22*c* and when the further cord 52*c* is moved in the first direction 60*c*, the slat 22*c* is tilted in a second direction 62*c* which is opposite to the first direction 60*c* for closing the slat 22*c*. Also, as shown in FIG. 5, the first end 82 of the second portion 78*c* is secured to the second termination 50*c* and the second end 84 of the second portion 78*c* is secured to the second end 56*c* of the further cord 52*c*.

Additionally, in all of the embodiments of the present invention, the apparatus 10 includes a lowermost slat 86 shown in FIG. 1 and a flexible lifting device 88 which has an upper and a lower end 90 and 92 respectively. The lower end 92 is rigidly secured to the lowermost slat 86, the lifting device 88 being slidably threaded through a first and a second aperture 94 and 96 respectively defined by the further tab 28 and the tab 16 respectively. The arrangement is such that, in operation of the apparatus 10, when the lifting device 88 is moved in a first direction 60, the lifting device 88 slides through the first aperture 94 until the further slat 34 is moved in the first direction 60 by the lowermost slat 86 and the lifting device 88 slides through the second aperture 96 until the slat 22 is moved in the first direction 60 by the lowermost slat 86 and the further slat 34.

More specifically, the lifting device 88 is a lifting cord and as shown in FIG. 1, a counterweight 98 is incorporated into the second end 20 of the tab 16 for compensating for the weight of the slat 22. Also, a further counterweight 100 is incorporated into the second extremity 32 of the further tab 28 for compensating for the weight of the further slat 34.The counterweight and further counterweight may be lamminated into the tab and further tab respectively.

Figure 6:
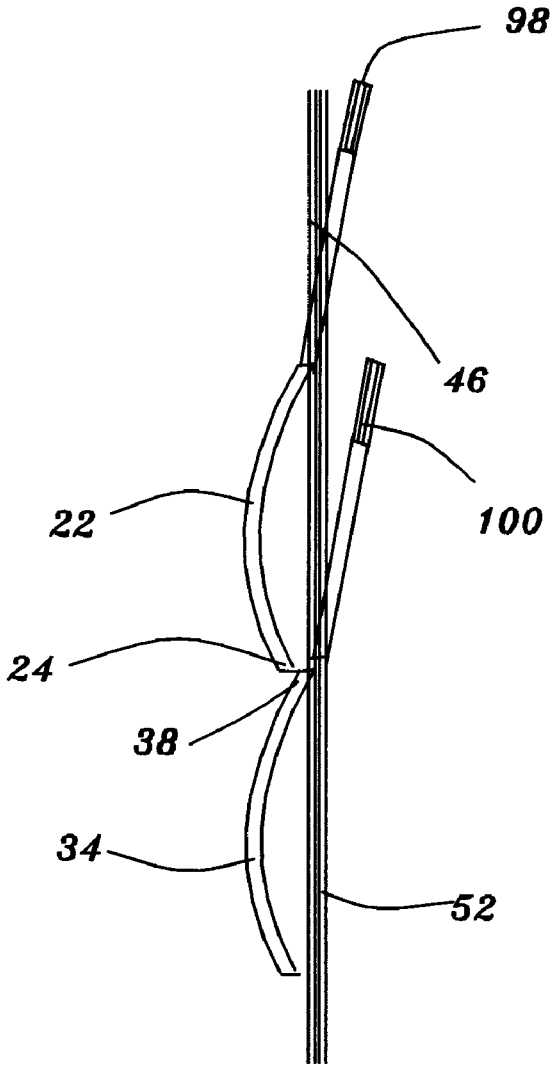
FIG. 6 is a side elevational view of the slat and further slat shown in FIG. 1 but with the slats closed.

FIG. 6 is a side elevational view of the slat 22 and further slat 34 shown in FIG. 1 but shown with the slats 22 and 34 closed. As shown in FIG. 6, when the slat 22 and further slat 34 are closed, the front edge 24 of the slat 22 is disposed closely adjacent to the further rear edge 38 of the further slat 34 so that overlapping of the further slat 34 by the slat 22 is avoided.

Figure 7:
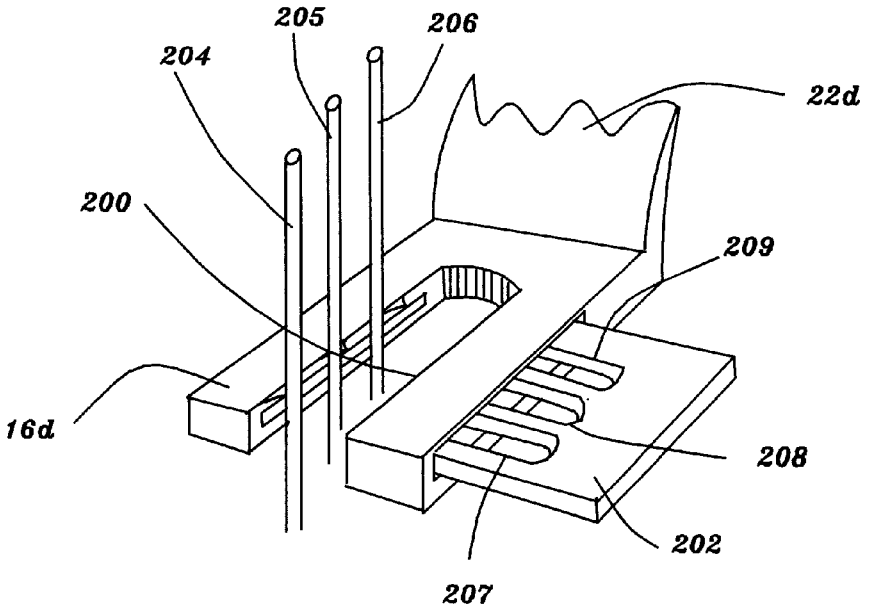
FIG. 7 is a perspective view of a further embodiment of the tab and slat according to the present invention.

FIG. 7 is a perspective view of a further embodiment of the tab and slat 22*d* according to the present invention. As shown in FIG. 7, a tab 16*d* includes a slot 200 and a slider 202 which slides within the slot 200 so that when the control cords 204, 205 and 206 are positioned within the slot 200, the cords 204–206 are trapped within channels 207, 208, and 209 respectively when the slider 202 is inserted into the slot 200.

Figure 8:
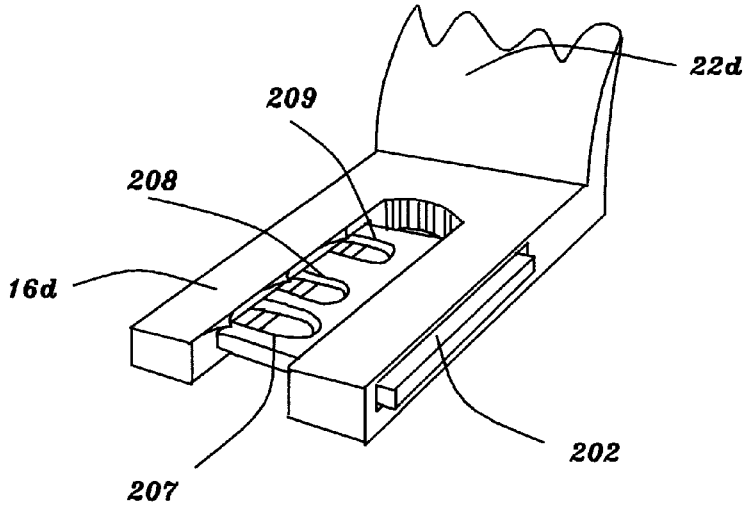
FIG. 8 is a similar view to that shown in FIG. 7 but shows the tab closed for holding the control cords.

FIG. 8 is a similar view to that shown in FIG. 7 but shows the tab closed for holding the control cords. As shown in FIG. 8, the slider 202 has been moved to the left to pinch the cords 204–206 within the channels 207–209.

Figure 9:
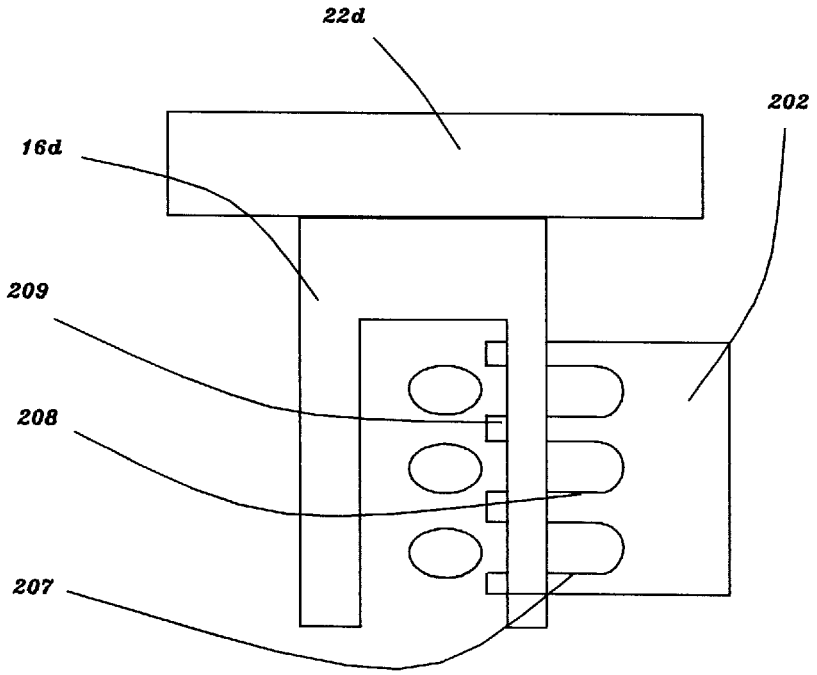
FIG. 9 is a top plan view of the tab and slat shown in FIG. 7.

FIG. 9 is a top plan view of the tab and slat shown in FIG. 7. As shown in FIG. 9, the slider 202 is shown in an open disposition for permitting threading of the control cords.

Figure 10:
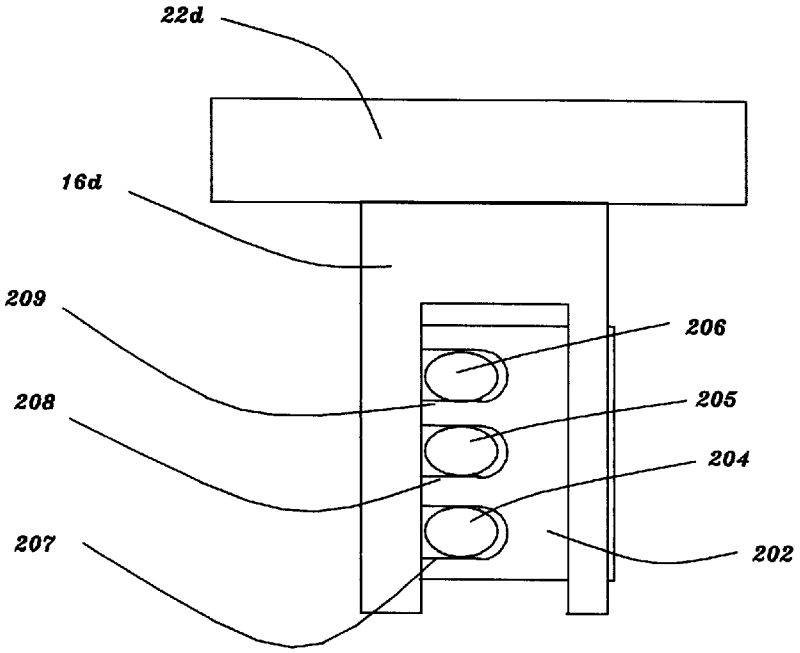
FIG. 10 is a top plan view of the tab and slat shown in FIG. 8.

FIG. 10 is a top plan view of the tab and slat shown in FIG. 8. As shown in FIG. 10, the slider 202 has been moved to pinch the cords 207–209.

Figure 11:
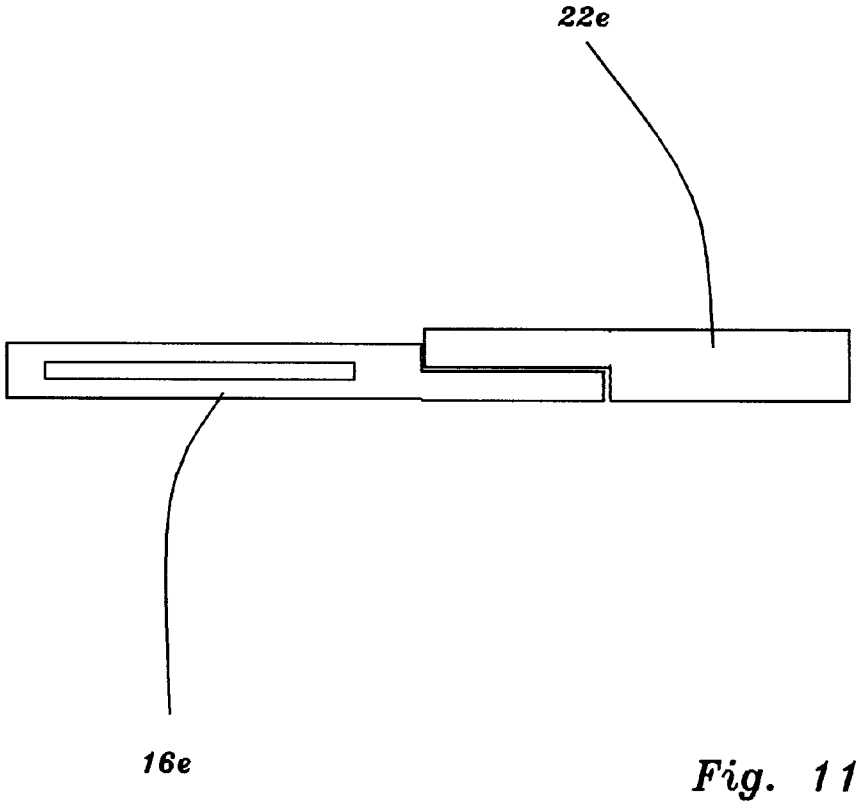
FIG. 11 is a side elevational view of a combined tab and slat according to another embodiment of the present invention for use with a flat slat.

FIG. 11 is a side elevational view of a combined tab 16*e* and slat 22*e* according to another embodiment of the present invention for use with a flat slat 22*e*.

The present invention provides a unique arrangement for supporting horizontal window blind slats so that cleaning thereof is facilitated.

What is claimed is:

1. A horizontal window blind apparatus for selectively controlling light transfer through a window, said apparatus comprising:

a frame disposed within the window;

a tab movably connected to and supported by said frame, said tab having a first and a second end; slat having a front and a rear edge, said rear edge of said slat being connected to said first end of said tab such that said slat is cantilevered from said tab;

a further tab movably connected to aid supported by said frame, said further tab having a first and second extremity;

a further slat disposed parallel relative to said slat, said further slat having a further front and a further rear edge, said further rear edge of said further slat being connected to said first extremity of said further tab such that said further slat is cantilevered from said further tab, the arrangement being such that in operation of said apparatus, when said tabs supported by said frame are moved, said slats cantilevered to said tabs are correspondingly moved for selectively controlling the light transfer through the window and for facilitating cleaning of said slats; and when said slat and further slat are closed, said front edge of said slat is disposed closely adjacent to said further rear edge of said further slat so that overlapping of said further slat by said slat is avoided.

2. A horizontal window blind apparatus as set forth in claim 1 wherein said frame includes:

a member defining an inverted channel, said member being disposed parallel relative to said slats.

3. A horizontal window blind apparatus as set forth in claim 2 wherein said frame further includes:

an elongate control rotatably supported by said member so that said elongate control is disposed within said inverted channel;

a flexible ladder having a first and a second termination, said first termination being connected to said elongate control;

a further flexible ladder having a first and a second end, said first end of said further ladder being connected to said elongate control so that, in operation of said apparatus, when said elongate control is rotated, said flexible ladder moves in a first direction and said further ladder moves in a second direction, said first and second directions being opposite to each other;

said second termination of said ladder being connected adjacent to said first end of said tab;

said second end of said further ladder being connected adjacent to said second end of said tab so that, when said elongate control is rotated, said first and second ends of said tab move in said opposite directions such that said cantilevered slat is tilted relative to said frame.

4. A horizontal window blind apparatus as set forth in claim 3 wherein said ladder includes:

a rung disposed adjacent to said first end of said tab so that when said ladder is moved in said first direction, said first end of said tab is lifted for opening said slat;

said further ladder including:

a further rung disposed adjacent to said second end of said tab so that when said further ladder is moved in said first direction, said second end of said tab is lifted for closing said slat.

5. A horizontal window blind apparatus as set forth in claim 1 wherein said tab is formed integrally with said slat.

6. A horizontal window blind apparatus as set forth in claim 1 wherein said tab and said slat are integrally molded.

7. A horizontal window blind apparatus as set forth in claim 1 wherein said tab and said slat are stamped from a metal sheet.

8. A horizontal window blind apparatus as set forth in claim 1 further including:

a lowermost slat;

a flexible lifting device having an upper and a lower end, said lower end being rigidly secured to said lowermost slat, said lifting device being slidably threaded through a first and a second aperture defined by said further tab and said tab respectively, the arrangement being such that, in operation of the apparatus, when said lifting device is moved in a first direction, said lifting device slides through said first aperture until said further slat is moved in said first direction by said lowermost slat and said lifting device slides through said second aperture until said slat is moved in said first direction by said lowermost slat and said further slat.

9. A horizontal window blind apparatus as set forth in claim 8 wherein said lifting device is a lifting cord.

10. A horizontal window blind apparatus for selectively controlling light transfer through a window, said apparatus comprising:

a frame disposed within the window;

a tab movably connected to and supported by said frame, said tab having a first and a second end;

a slat having a front and a rear edge, said rear edge of said slat being connected to said first end of said tab such that said slat is cantilevered from said tab;

a further tab movably connected to and supported by said frame, said further tab having a first and a second extremity;

a further slat disposed parallel relative to said slat, said further slat having a further front and a further rear edge, said further rear edge of said further slat being connected to said first extremity of said further tab such that said further slat is cantilevered from said further tab, the arrangement being such that in operation of said apparatus, when said tabs supported by said frame are moved, said slats cantilevered to said tabs are correspondingly moved for selectively controlling the light transfer through the window and for facilitating cleaning of said slats;

said frame including:

a member defining an inverted channel, said member being disposed parallel relative to said slats;

said tab defining a first slot which is disposed adjacent to said first end of said tab for fixedly engaging a ladder; and said tab further defining a second slot which is disposed adjacent to said second end of said tab for fixedly engaging a further ladder.

11. A horizontal window blind apparatus for selectively controlling light transfer through a window, said apparatus comprising:

a frame disposed within the window;

a tab movably connected to and supported by said frame, said tab having a first and a second end, a slat having a front and a rear edge, said rear edge of said slat being connected to said first end of said tab such that said slat is cantilevered from said tab;

a further tab movably connected to and supported by said frame, said further tab having a first and a second extremity;

a further slat disposed parallel relative to said slat, said further slat having a further front and a further rear edge, said further rear edge of said further slat being connected to said first extremity of said further tab such that said further slat is cantilevered from said further tab, the arrangement being such that in operation of said apparatus, when said tabs supported by said frame are moved, said slats cantilevered to said tabs are correspondingly moved for selectively controlling the light transfer through the window and for facilitating cleaning of said slats;

said tab including:

a first portion having a proximal and a distal end, said proximal end being rigidly secured to said rear edge of said slat; and a second portion defining a recess for removably receiving therein said distal end of said first portion, said second portion being connected to and supported by said frame.

12. A horizontal window blind apparatus as set forth in claim 11 wherein said second portion has a first and a second end;

said apparatus further including:

a cord having a first and a second termination, said second termination being secured to said first end of said second portion;

a further cord having a first and a second end, said second end of said further cord being secured to said second end of said second portion, the arrangement being such that, in operation of the apparatus, when said cord is moved in a first direction, said slat is tilted in said first direction for opening said slat and when said further cord is moved in said first direction, said slat is tilted in a second direction which is opposite to said first direction for closing said slat.

13. A horizontal window blind apparatus for selectively controlling light transfer through a window, said apparatus comprising:

a frame disposed within the window;

a tab movably connected to and supported by said frame, said tab having a first and a second end;

a slat having a front and a rear edge, said rear edge of said slat being connected to said first end of said tab such that said slat is cantilevered from said tab;

a further tab movably connected to and supported by said frame, said further tab having a first and a second extremity;

a further slat disposed parallel relative to said slat, said further slat having a further front and a further rear edge, said further rear edge of said further slat being connected to said first extremity of said further tab such that said further slat is cantilevered from said further tab, the arrangement being such that in operation of said apparatus, when said tabs supported by said frame are moved, said slats cantilevered to said tabs are correspondingly moved for selectively controlling the light transfer through the window and for facilitating cleaning of said slats;

a counterweight incorporated into said second end of said tab for compensating for the weight of said slat; and a further counterweight incorporated into said second extremity of said further tab for compensating for the weight of said further slat.

14. A horizontal window blind apparatus for selectively controlling light transfer through a window, said apparatus comprising:

a frame disposed within the window;

a tab movably connected to and supported by said frame, said tab having a first and a second end;

a slat having a front and a rear edge, said rear edge of said slat being connected to said first end of said tab such that said slat is cantilevered from said tab;

a further tab movably connected to and supported by said frame, said further tab having a first and a second extremity;

a further slat disposed parallel relative to said slat, said further slat having a further front and a further rear edge, said further rear edge of said further slat being connected to said first extremity of said further tab such that said further slat is cantilevered from said further tab, the arrangement being such that in operation of said apparatus, when said tabs supported by said frame are moved, said slats cantilevered to said tabs are correspondingly moved for selectively controlling the light transfer through the window and for facilitating cleaning of said slats;

said tab including:

a first portion having a proximal and a distal end, said proximal end being connected to said rear edge of said slat; and a second portion defining a recess for removably receiving therein said distal end of said first portion, said second portion being connected to and supported by said frame.

15. A horizontal window blind apparatus for selectively controlling light transfer through a window, said apparatus comprising:

a frame disposed within the window;

a cord having a first and a second termination;

a tab, said tab having a first and a second end, said first end of said tab being connected to said second termination of said cord;

a slat having a front and a rear edge, said rear edge of said slat being connected to said first end of said tab such that said slat is cantilevered from said tab;

a further cord having a first and a second end;

a further tab, said further tab having a first and a second extremity, said second extremity of said further tab being connected to said second end of said further cord;

a further slat disposed parallel relative to said slat, said further slat having a further front and a farther rear edge, said further rear edge of said further slat being connected to said first extremity of said further tab such that said further slat is cantilevered from said further tab, the arrangement being such that in operation of said apparatus, when said tabs supported by said frame are moved, said slats cantilevered to said tabs are correspondingly moved for selectively controlling the light transfer through the window and for facilitating cleaning of said slats;

said tab defining a first slot which is disposed adjacent to said first end of said tab for fixedly engaging said cord; and said tab farther defining a second slot which is disposed adjacent to said second end of said tab for fixedly engaging said further cord.

* * * * *